United States Patent [19]

Voorhies, Jr.

[11] Patent Number: 4,793,519

[45] Date of Patent: Dec. 27, 1988

[54] COMPOSITE SHIPPING CONTAINER

[75] Inventor: John Voorhies, Jr., Strongsville, Ohio

[73] Assignee: Hoover Group, Inc., Alpharetta, Ga.

[21] Appl. No.: 28,865

[22] Filed: Mar. 23, 1987

[51] Int. Cl.[4] ..... B65D 35/14

[52] U.S. Cl. ..... 220/465; 220/403

[58] Field of Search ..... 220/465, 470, 462, 410, 220/403, 5 A, 1 B, 1.5

[56] References Cited

U.S. PATENT DOCUMENTS

| | | | |
|---|---|---|---|
| 2,926,830 | 3/1960 | Kennedy et al. | 220/465 X |
| 2,946,494 | 7/1960 | Kuss | 220/465 X |
| 3,226,002 | 12/1965 | Walker | 220/465 X |
| 4,173,288 | 11/1979 | Schutz | 220/462 X |
| 4,426,015 | 1/1984 | Preston et al. | 220/403 |
| 4,516,692 | 5/1985 | Croley | 220/403 X |
| 4,666,059 | 5/1987 | Nordstrom | 220/465 |

*Primary Examiner*—Steven M. Pollard

*Attorney, Agent, or Firm*—Harness, Dickey & Pierce

[57] ABSTRACT

A composite disposable one-way container comprising an outer container of rectangular shape having upright continuous side walls and a substantially flat top wall formed of corrugated paper material. A unitary blow molded plastic inner tank having thin side walls is positioned upright inside the outer container so that the outer container maintains the inner tank in its upright position when the tank is filled with a liquid to be transported. A pallet member has a flat top supporting surface on which the outer container and the inner tank are supported.

2 Claims, 1 Drawing Sheet

COMPOSITE SHIPPING CONTAINER

BACKGROUND OF THE INVENTION

Figure 1:
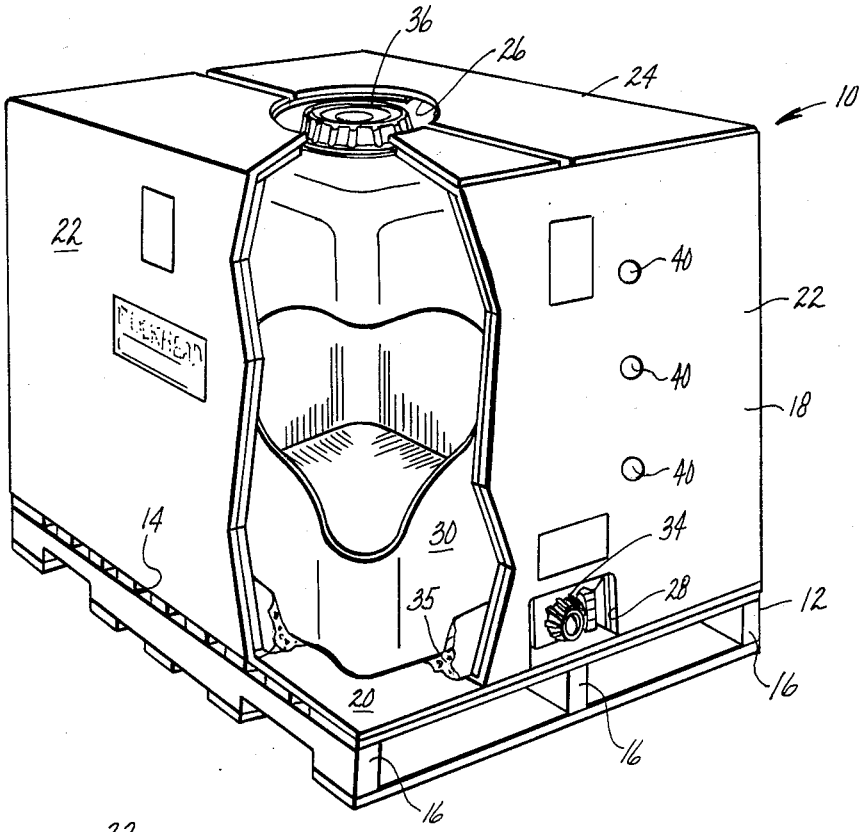

Liquid material in bulk form is commonly stored and transported in a variety of large containers the most common being the conventional fifty-five gallon drum. The disadvantages in the drum are related to the inefficient storage space of cylindrical containers, the necessity for returning the drums empty, and the necessity to invert the drum for discharge purposes.

In recent years, a metal container of cubic shape and containing an inner polyethylene tank has provided an advantageous alternative to the fifty-five gallon drum. However, in the metal and polyethylene composite container, separation of the inner tank from the outer metal container is difficult. Such separation is required after the container has been used and it is desired to re-cycle the container materials. It is also desirable from a cost standpoint to eliminate the necessity for metal in the container.

It is an object of the present invention, therefore, to provide a composite shipping container which has the advantage of the cubic configuration but in addition overcomes the disadvantages resulting from the necessity of the metal support for the polyethylene tank in past containers of this configuration.

SUMMARY OF THE INVENTION

The composite shipping container of this invention consists of a disposable outer container of rectangular shape having a rectangular bottom wall, upright continuous side walls and a substantially flat top wall. All of the walls are formed of a corrugated paper material that is less expensive than metal but is sufficiently strong to accomplish the purposes of this invention.

A unitary blow molded plastic inner tank is positioned upright inside the outer container. The side walls of the tanks are sufficiently thin to prevent the tank from being self supporting. The tank also has an inlet fitting extending into the container fill opening and a discharge fitting extending into the container discharge opening.

The outer container is mounted at its bottom wall on a pallet member which has depending legs enabling extension of forklift times therebetween to facilitate handling of the container. The container side walls, being of multi-layer construction, maintain the plastic tank in an upright position in the container when the tank is filled with a liquid to be transported and the multi-layer construction of the top wall enables two such containers to be stacked two high.

The composite shipping container of this invention has the advantage of being a one-way shipper. In other words, the composite container can be shipped one way with the container filled with a liquid, and after the container has been emptied, the outer container can be readily separated from the inner blow molded tank for subsequent recycling of both the corrugated paper material and the polyethylene from the tank. The one-way feature has obvious advantages from a cost stand point.

Figure 3:
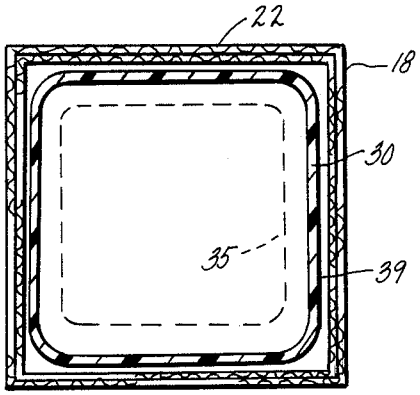
Figure 2:
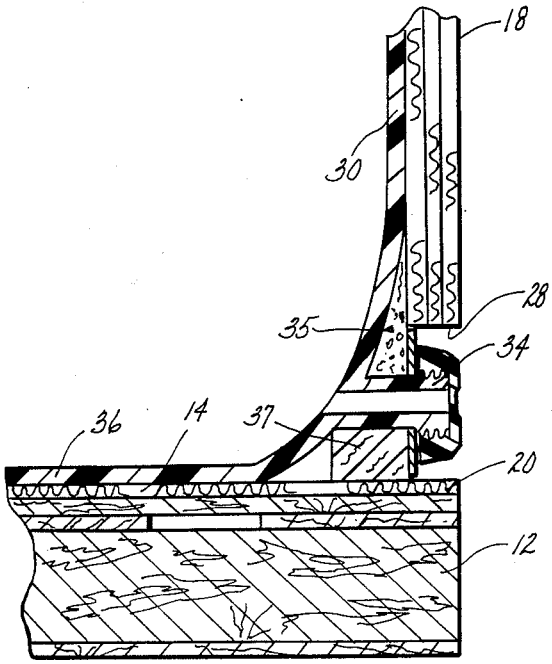

Further objects, features and advantages of the invention will become apparent from a consideration of the following description and the appended claims when taken in connection with the accompanying drawing in which:

FIG. 1 is a prespective view of the composite shipping container of this invention with parts broken away for the purpose of clarity; and FIG. 2 is a detail sectional view of the discharge fitting on the tank and the associated portion of the container; and FIG. 3 is a horizontal sectional view of the container of this invention.

With reference to the drawing, the composite shipping container of this invention, indicated generally at 10, is illustrated in FIG. 1 as including a pallet member 12 having a top surface 14 and depending legs 16 which are spaced apart to enable extension of forklift tines (not shown) therebetween to facilitate moving and handling of the container 10 during transport and storage.

The container 10 also includes and outer container 18 of rectangular shape having a rectangular bottom wall 20 supported on and secured to the pallet top surface 14. The outer container 18 also has upright continuous side walls 22 and a substantially flat top wall 24. All of the walls 20, 22 and 24 are formed of a corrugated paper material which is readily available from corrugated box manufacturing companies. As shown in FIGS. 1 and 2, the side and top walls 22 and 24 are of multi-layer construction for a purpose to appear presently. The top wall 24 has a central filling opening 26 and one of the side walls has a discharge opening 28 located adjacent to the bottom wall 20.

A unitary blow molded plastic inner tank 30 of very thin wall construction is positioned upright inside the outer container 18 so that a top fill cap 32 on the tank 30 projects into the opening 26 in the top wall 24 and a bottom discharge fitting 34 on the tank 30 extends into the discharge opening 28. The corners and edges of the tank 30 are rounded as shown in FIGS. 1–3 and the tank 30 is nested at its lower end in a styrofoam pad 35 of rectangular ring shape. The multi-layer construction of the container side walls 22 maintains the tank 30 in an upright position in the container 18 when the tank is filled with a liquid to be transported. The pad 35 also helps maintain the tank 30 in an upright position in the container 18. The container top wall 24, being of similar multi-layer construction, enables two such containers to be stacked two high with the pallet 12 on the upper container resting on the top wall 24 of the lower container.

Because of its cubic configuration, the container 10 can be efficiently transported and stored and because of the location of the discharge fitting 34 adjacent the bottom wall 36 of the tank 30, the tank can be completely emptied with a minimum of handling and manipulation. A support block 37 affixed to discharge fitting 34 supports the discharge fitting 34 to also help keep the front vertical panel of tank 30 in a vertical position. As shown in FIG. 3, the tank 30 is spaced from the container side walls 22 in the empty condition of the tank 30. This enables the tank 30 to swell as it is filled with liquid thereby displaceing the air in the space 39 between the tank 30 and the container side walls 22. This air escapes the container 18 through sight holes 40 in the side walls 22. The provision of the space 39 enables the tank 30 to swell without damaging the container side walls 22.

Once the tank 30 has been emptied, the shipping container 10 can readily be disassembled because the corrugated paper outer container 18 can be manually removed from its position enclosing the plastic tank 30. The outer container 18 and the tank 30 are thus readily separated so that they can be separately recycled according to processes appropriate for the paper and plastic materials from which the containers 18 and 30 are respectively formed.

The container 10 of this invention is thus readily useable as a one-way container to enable reduction in shipping costs.

What is claimed is:

1. A composite disposable one-way container having vertical stacking capabilities comprising:

a. a pallet member having a top surface and depending legs spaced apart to enable extension of fork lift tines therebetween, b. an outer container of rectangular shape having a rectangular bottom wall supported on the secured to said pallet top surface, said outer container having upright continuous side walls and a substantially flat top wall formed of corrugated paper material, said top wall having a central fill opening and one of said side walls having a discharge opening located adjacent said bottom wall, and c. a unitary blow molded plastic inner tank positioned upright inside said outer container and having side walls sufficiently thin to prevent said tank from being self supporting, said tank having an inlet fitting extending into said container fill opening, and a discharge fitting extending into said container discharge opening, d. a support structure for said inner tank on said outer container bottom wall, said structure having a complimentary surface abutting said inner tank and said outer container side walls so as to nest said inner tank on said support structure and provide support for said discharge fitting, said container side walls being of multi-layered construction to maintain said tank in an upright position in said container when the tank is filled with a liquid to be transported, said container side walls being free of obstruction on the inner sides thereof so that said inner tank side walls are free to engage said inner sides of the container side walls directly when the tank is filled with a liquid to be transported, and said container top wall being of similar multi-layered construction to enable two such containers to be stacked two high.

2. The container according to claim 1 wherein said tank and outer container are configured to provide an air space therebetween in the empty condition of said tank.

* * * * *